US008581944B2

(12) United States Patent
Okada et al.

(10) Patent No.: US 8,581,944 B2
(45) Date of Patent: Nov. 12, 2013

(54) IMAGE FORMING APPARATUS AND METHOD FOR DETECTING POSITION DEVIATION

(75) Inventors: Tatsuhiko Okada, Saitama (JP); Nobuyuki Satoh, Kanagawa (JP); Masato Kobayashi, Kanagawa (JP); Norikazu Taki, Kanagawa (JP); Daisuke Sawada, Saitama (JP); Daisaku Horikawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 13/047,469

(22) Filed: Mar. 14, 2011

(65) Prior Publication Data

US 2011/0228027 A1 Sep. 22, 2011

(30) Foreign Application Priority Data

Mar. 18, 2010 (JP) ..... 2010-063375

(51) Int. Cl.
*B41J 2/385* (2006.01)
*B41J 29/393* (2006.01)
*B41J 2/45* (2006.01)

(52) U.S. Cl.
USPC ..... 347/116; 347/19; 347/238

(58) Field of Classification Search
None
See application file for complete search history.

(56) References Cited

U.S. PATENT DOCUMENTS 6,174,095 B1 * 1/2001 Desie et al. ..... 400/118.3
7,251,055 B2 * 7/2007 Sawada et al. ..... 358/1.9

FOREIGN PATENT DOCUMENTS

JP 2007-038546 2/2007
JP 4019654 12/2007
JP 2008-132732 6/2008

* cited by examiner

*Primary Examiner* — Stephen Meier
*Assistant Examiner* — Alexander C Witkowski
(74) *Attorney, Agent, or Firm* — IPUSA, PLLC

(57) ABSTRACT

An image forming apparatus includes a photoconductor drum, a first printer head that forms a first pattern on the photoconductor drum and has a first end part, a second printer head that forms second and third patterns on the photoconductor drum and has a second end part that overlaps the first end part in a main scanning direction, a detection sensor that detects the densities of first and second test patterns formed at an area of the photoconductor drum at which the first and second end parts overlap, the first test pattern being formed by combining the first and second patterns, the second test pattern being formed by combining the first and third patterns, and a determination part that determines a deviation direction between the first and second printer heads by comparing the densities detected by the detection sensor.

16 Claims, 7 Drawing Sheets

IMAGE FORMING APPARATUS AND METHOD FOR DETECTING POSITION DEVIATION

BACKGROUND OF THE INVENTION

1. Field of the Invention

The present invention relates to an image forming apparatus, a method, and a computer-readable recording medium for detecting position deviation.

2. Description of the Related Art

An image forming apparatus that uses an electrophotography method (e.g., wide format copier, wide format printer) is equipped with an optical writing apparatus including an array of inexpensive light emitting devices (light emitting device array) having a width equivalent to the width of A3 or A4 paper. For example, the optical writing apparatus may include plural LED (Light Emitting Diode) printer heads having plural LEDs and being arranged in a zigzag manner with respect to the main scanning direction, so that writing can be performed on a wide area.

However, with the optical writing apparatus having plural LED printer heads arranged in the main scanning direction, dots formed at a boundary area between adjacent LED printer heads may deviate depending on the precision or the error in which the LED printer heads are positioned or the thermal expansion of the LED printer heads. The deviation of dots results in the generation of undesired black lines or white lines. Thereby, image quality is degraded.

In order to prevent the degrading of image quality, Japanese Patent No. 4019654 discloses an image forming apparatus that uses a sensor to detect the amount of position deviation at the boundary area of adjacent LED printer heads and corrects the position deviation.

With this image forming apparatus, position deviation of LED printer heads is detected by using a PSD (Position Sensitive Detector) sensor that receives light directly from the LED printer heads and referring to the output level of the PSD sensor with respect to the illuminating order and the light quantity of LEDs of the LED printer heads.

However, in order to detect position deviation using this image forming apparatus, it is necessary to position the PSD sensor between a printer head and a photoconductor drum or to provide a light guiding member for guiding light from a printer head to the PSD sensor. However, positioning the PSD sensor between the printer head and the photoconductor drum is extremely difficult because the focal distance of the printer head (space between the printer head and the photoconductor drum) is approximately 2 mm. Moreover, providing the light guiding member increases the size of the image forming apparatus, complicates the configuration of the image forming apparatus, and increases manufacturing cost.

Japanese Laid-Open Patent Publication No. 2007-038546 discloses an image forming apparatus having plural LED printer heads arranged in a zigzag manner with respect to the main scanning direction of a photoconductor and arranging density detection sensors at areas in which the LED printer heads are overlapped. The density detection sensors detect the density of a toner image for a single rotation of the photoconductor. According to the detection result of the density detection sensors, the image forming apparatus corrects the position deviation of the focus of each LED printer head by adjusting the light quantity of each LED printer head.

However, this image forming apparatus requires plural density detection sensors to be arranged at the areas in which the LED printer heads are overlapped. This increases manufacturing cost. Moreover, in a case of correcting the position deviation of the focus of each LED printer head, it is difficult to determine the direction of the position deviation.

SUMMARY OF THE INVENTION

The present invention may provide an image forming apparatus, a method, and a computer-readable recording medium for detecting position deviation that substantially eliminates one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an image forming apparatus, a method, and a computer-readable recording medium for detecting position deviation particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an image forming apparatus including a photoconductor drum, a first printer head that forms a first pattern on the photoconductor drum and includes a first end part, a second printer head that forms second and third patterns on the photoconductor drum and includes a second end part that overlaps the first end part in a main scanning direction, a detection sensor that detects the densities of first and second test patterns formed at an area of the photoconductor drum at which the first and second end parts overlap, the first test pattern being formed by combining the first and second patterns, the second test pattern being formed by combining the first and third patterns, and a determination part that determines a deviation direction between the first and second printer heads by comparing the densities detected by the detection sensor.

Other objects, features and advantages of the present invention will become more apparent from the following detailed description when read in conjunction with the accompanying drawings.

DETAILED DESCRIPTION OF THE PREFERRED EMBODIMENTS

Embodiments of an image forming apparatus are described with the accompanying drawings.

Figure 1:
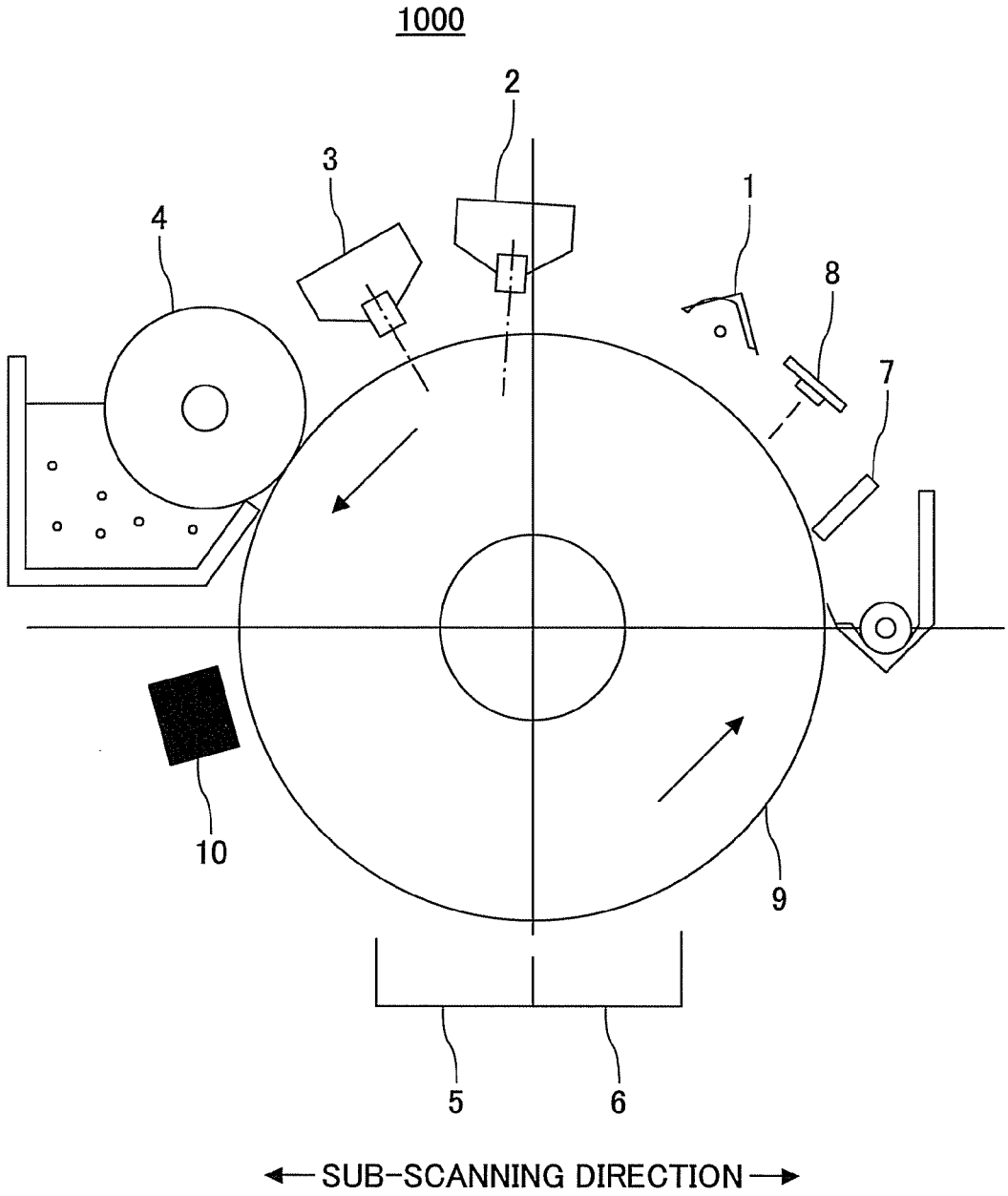
FIG. 1 is a schematic diagram illustrating a main part of an image forming apparatus according to an embodiment of the present invention.

FIG. 1 is a schematic diagram illustrating a main part of an image forming apparatus 1000 according to an embodiment of the present invention. As illustrated in FIG. 1, the image forming apparatus 1000 includes a photoconductor having a drum-like shape (photoconductor drum) 9 and a rotation driving apparatus (not illustrated) that rotates the photoconductor drum 9 around its axis at a predetermined speed. Further, the image forming apparatus 1000 also includes a charger 1, a first printer head (also referred to as "first LED printer head" or "first LPH") 2, a second printer head (also referred to as "second LED printer head" or "second LPH") 3, a developer apparatus 4, a density detection sensor (hereinafter also referred to as "density detection part" or simply "detection sensor") 10, a transfer charger 5, a separation charger 6, a cleaning unit 7, and an antistatic lamp 8 that are arranged around the photoconductor drum 9 along a rotation direction (sub-scanning direction) of the photoconductor drum 9. In this embodiment, the charger 1, the first printer head 2, the second printer head 3, the developer apparatus 4, the density detection sensor 10, the transfer charger 5, the separation charger 6, the cleaning unit 7, and the antistatic lamp 8 are arranged around the photoconductor drum 9 in this order.

The charger 1 uniformly charges an outer peripheral surface of the photoconductor drum 9. The first and second printer heads 2, 3 form an electrostatic latent image(s) on the charged outer peripheral surface of the photoconductor drum 9 by irradiating light (pattern light) to the charged outer peripheral surface of the photoconductor drum 9. The developer apparatus 4 develops the electrostatic latent image of the photoconductor drum 9 with a developer powder (toner). The toner images developed on the outer peripheral surface of the photoconductor drum 9 are overlapped and transferred to a transfer sheet by the transfer charger 5.

The separation charger 6 separates the transfer paper from the photoconductor drum 9. The cleaning unit 7 cleans the outer peripheral surface of the photoconductor drum 9 by removing residual toner remaining on the outer peripheral surface of the photoconductor drum 9. The antistatic lamp 8 uniformly eliminates the charges remaining on the cleaned outer peripheral surface of the photoconductor drum 9. The density detection sensor 10 includes a density detecting part for detecting (measuring) the density of the image formed on the outer peripheral surface of the photoconductor drum 9. The density detecting part 10 is, for example, a detection sensor such as a reflection type photosensor. As described below, the density detecting part 10 is used for detecting the deviation of the position of the first and second printer heads 2, 3 and the direction of the deviation of position of the first and second printer heads 2, 3.

The first and second printer heads 2, 3 are arranged along the width direction (main scanning direction) of the photoconductor drum 9 and separated apart from each other in the sub-scanning direction at a predetermined distance (interval) in the rotation direction of the photoconductor drum 9. Further, the first and second printer heads 2, 3 are positioned in correspondence with different predetermined regions of the photoconductor drum 9. Further, the first and second printer heads 2, 3 are positioned in a manner that a first end part 2*a* of the first printer head 2 and a second end part 3*a* of the second printer head 3 are overlapped in the main scanning direction in a boundary area (joining area) between the first and second printer heads 2, 3. Thereby, the predetermined region of the photoconductor drum 9 corresponding to the first printer head 2 and the predetermined region of the photoconductor drum 9 corresponding to the second printer head 3 partly overlap with each other. Accordingly, the first and second printer heads 2, 3 are arranged at predetermined sections that divide the photoconductor drum 9 in the width direction of the photoconductor drum 9, so that the first and second printer heads 2, 3 overlap at the boundary area along the main scanning direction of the photoconductor drum 9. The first and second printer heads 2, 3 span across the entire photoconductive area of the photoconductor drum 9 in the main scanning direction of the photoconductor drum 9 in a manner that the first and second end parts 2*a*, 3*a* of the first and second printer heads 2, 3 are overlapped in the main scanning direction.

The first and second printer heads 2, 3 include plural light emitting devices arranged in a linear (array) manner. In this embodiment, the plural light emitting devices of the first and second printer heads 2, 3 are LEDs. Thus, in this embodiment, the first and second printer heads 2, 3 irradiate light generated by illuminating each of the LEDs and form an electrostatic latent image on the surface of the photoconductor drum 9. The image forming apparatus 1000 forms (writes) images on predetermined divided regions of the photoconductor drum 9 by using the first and second printer heads 2, 3, forms a latent image by combining the images, and develops the latent image with toner of the developer apparatus 4.

Figure 2A:
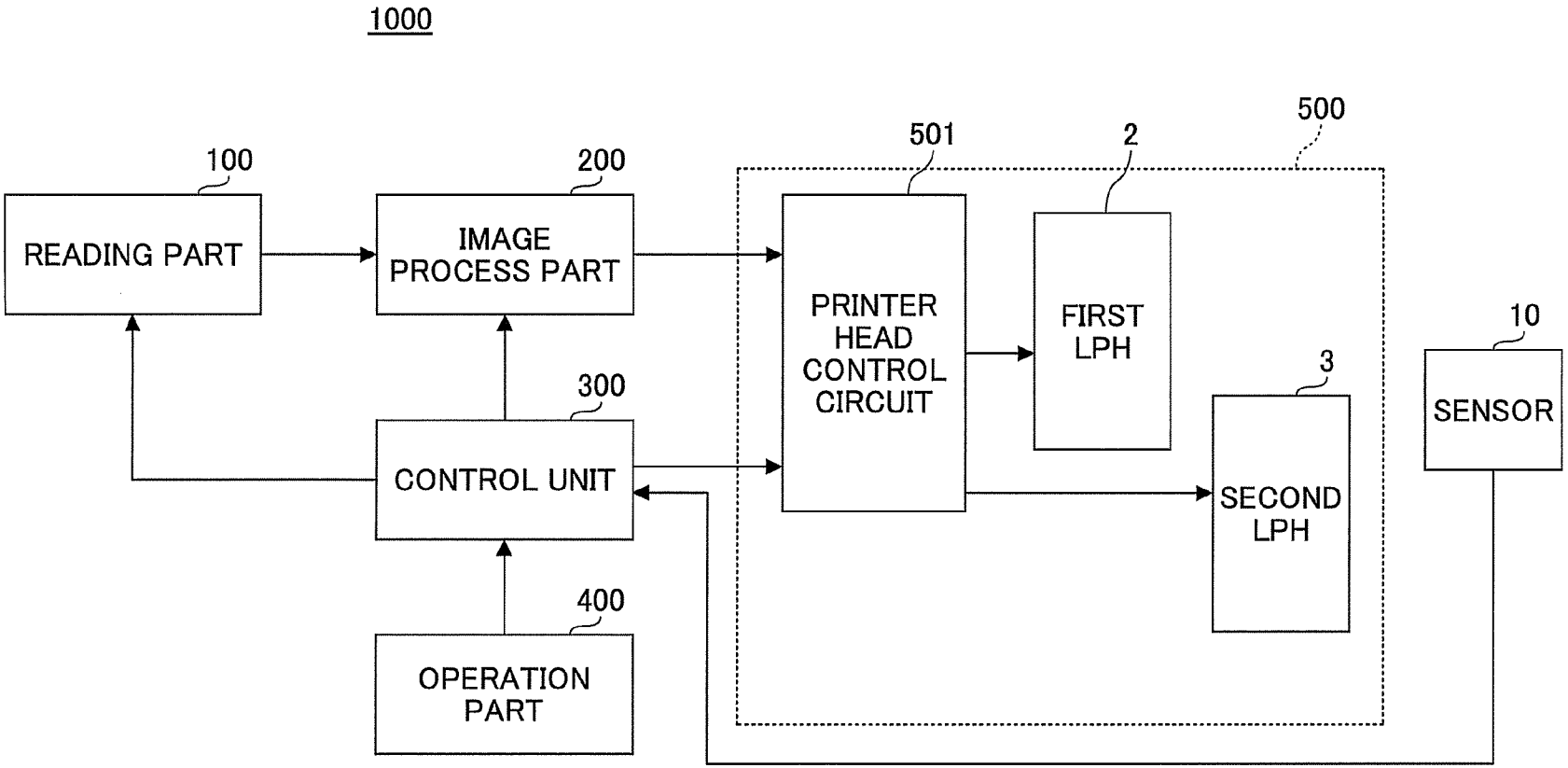
FIG. 2A is a block diagram illustrating a configuration of an image forming apparatus according to an embodiment of the present invention.
Figure 2B:
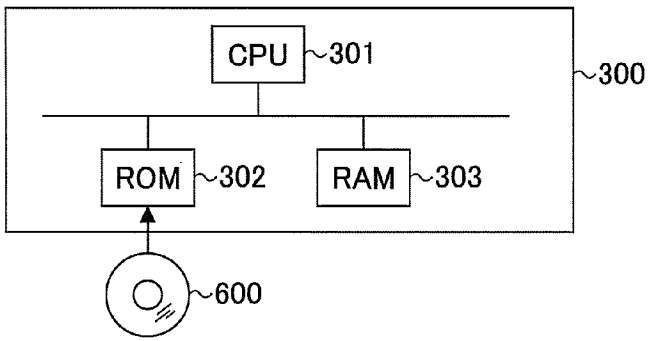
FIG. 2B is a block diagram illustrating an inside configuration of a control unit of an image forming apparatus according to an embodiment of the present invention.
Figure 2C:
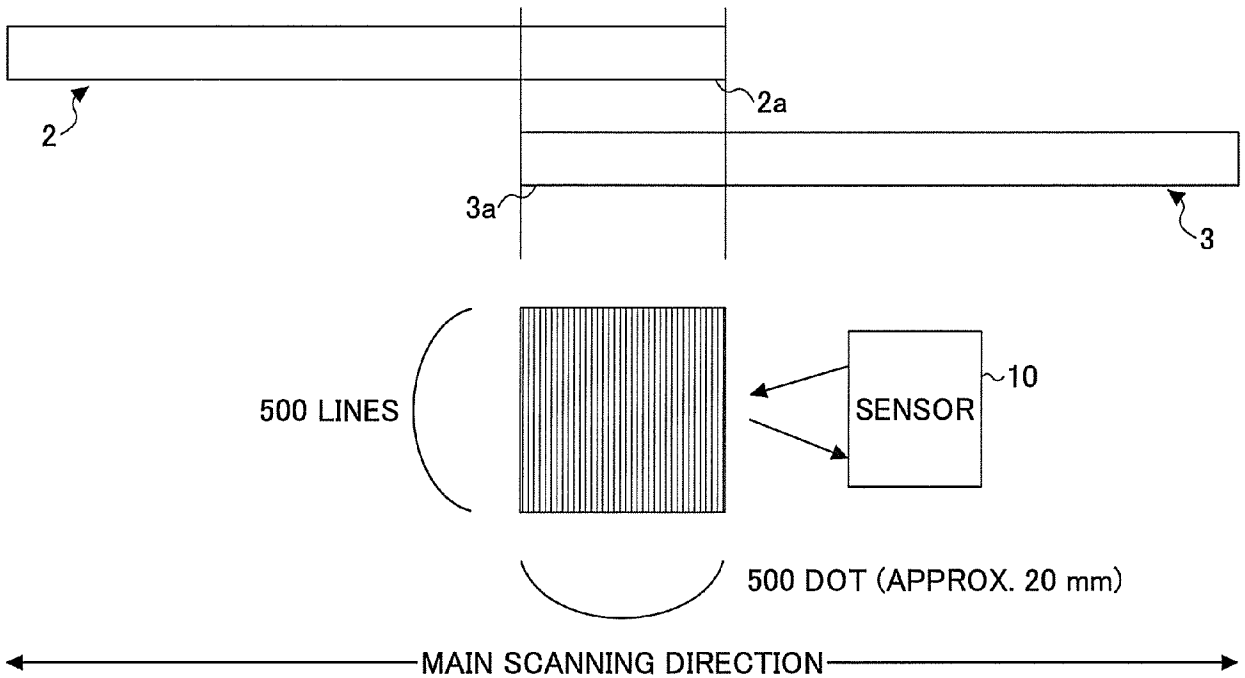
FIG. 2C is a schematic diagram for describing how first and second printer heads are positioned according to an embodiment of the present invention.

FIG. 2A is a block diagram illustrating a configuration of the image forming apparatus 1000 according to an embodiment of the present invention. FIG. 2B is a block diagram illustrating an inside configuration of a control unit 300 of the image forming apparatus 1000. FIG. 2C is a schematic diagram for describing how the first and second printer heads 2, 3 are positioned. In the drawings, it is to be noted that "LPH" indicates an LED printer head.

As illustrated in FIG. 2A, the image forming apparatus 1000 includes a reading part 100 for reading an image from a document, an image processing part 200 for performing image processing on the image read out (image data) from the document, and a writing part 500 for writing the image in a case of, for example, copying the document. Further, the image forming apparatus 1000 also includes the control unit 300 for controlling the entire image forming apparatus 1000, an operation part 400 for sending, for example, input data (e.g., key-entry data) to the control unit 300, and the density detection sensor 10 connected to the control unit 300.

As illustrated in FIG. 2B, the control unit 300 according to an embodiment of the present invention is, for example, a computer having a CPU (Central Processing Unit) 301 for executing various calculations/processes, a ROM (Read Only Memory) 302 for storing, for example, various setting data, programs, and data therein, and a RAM (Random Access Memory) 302 for temporarily storing data directly accessed by the CPU 301. In this embodiment, a position deviation direction determining function of the below-described position deviation direction determination part is performed by executing a predetermined program with the control unit 300. According to an embodiment of the present invention, the predetermined program may be installed in the ROM 302 from a computer-readable recording medium 600.

In the writing part 500 illustrated in FIG. 2A, signals of image data are transferred from the image process part 200 to the printer head control circuit 501. The printer head control circuit 501 converts the signals into bits in units of pixels. Then, the converted bits are transferred to the first and second printer heads 2, 3 to be further converted into light (in this embodiment, infrared light) at the first and second printer heads 2, 3. Then, the converted light is output from the first and second printer heads 2, 3. In irradiating the light from the first and second printer head 2, 3, the printer head control part 501 divides the image with respect to the width direction of the photoconductor drum 9 and transfers data of the divided image (divided image data) to the first and second printer heads 2, 3 in parallel. Compared to the first printer head 2, the second printer head 3 is positioned more downstream of the rotation direction of the photoconductor drum 9. Therefore, the printer head control part 501 transfers the divided image data to the second printer head 3 via a delay circuit, so that the divided image data transferred to the second printer head 3 can be delayed in correspondence with the space between the first and second printer heads 2, 3 with respect to the sub-scanning direction of the first and second printer heads 2, 3 and in correspondence with the delay time determined by the peripheral speed of the photoconductor drum 9. Thereby, an image (printing mark) formed (written) by the first printer head 2 and an image (printing mark) formed (written) by the second printer head 3 can be combined to form a single line.

With the image forming apparatus 1000, the accuracy and error of the positions in which the first and second printer heads 2, 3 are mounted may deviate from a predetermined position with respect to the main scanning direction (position deviation). In order to correct the position deviation of the first and second printer heads 2, 3, it is necessary to, for example, detect the amount of deviation and the direction of the deviation of the first and second printer heads 2, 3 and adjust the position in which the first and second printer heads 2, 3 are mounted.

In other words, as illustrated in the below-described FIGS. 3A and 3B, in a case where a first pattern (including a printing mark(s)) 300*a* formed on the photoconductor drum 9 by the first printing head 2 and a second pattern (including a printing mark(s)) 300*b* formed on the photoconductor drum 9 by the second printing head 3 are overlapped when the position deviation occurs at the boundary area between the first and second printer heads 2, 3, the second pattern 300*b* formed by the second printing head 3 deviates either to the right or the left with respect to the first pattern 300*a* formed by the first printer head 2.

Accordingly, it is necessary to detect the amount of deviation and the direction of the deviation of the first and second printer heads 2, 3 for adjusting the deviation in which the first and second printer heads 2, 3 are mounted.

First, the principle (method) for detecting the amount of deviation of the first and second printer heads 2, 3 is described.

Figure 3A:
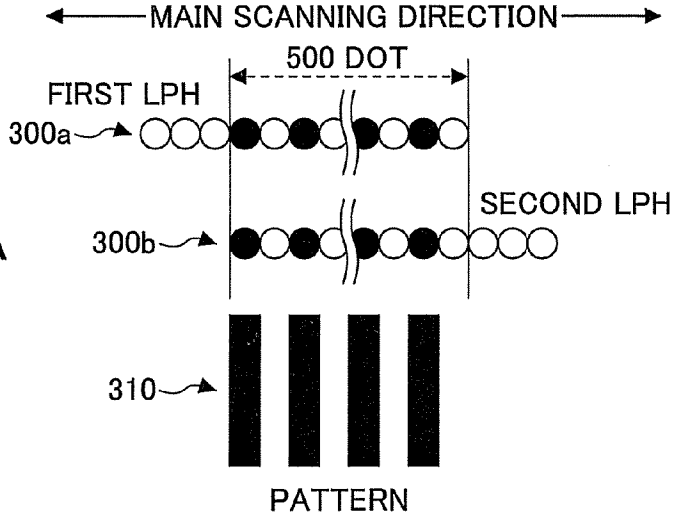
FIG. 3A shows a pattern (test pattern) illustrated in correspondence with dots of first and second patterns in a case where there is no deviation of first and second printer heads at a boundary area according to an embodiment of the present invention.
Figure 3C:
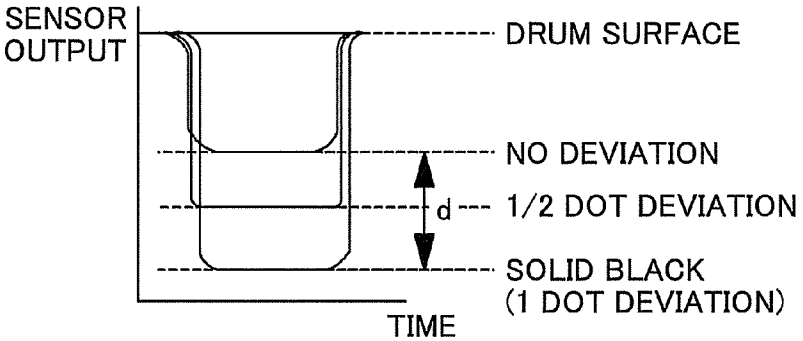
FIG. 3C is a chart indicating output of a density detection sensor according to an embodiment of the present invention.
Figure 3B:
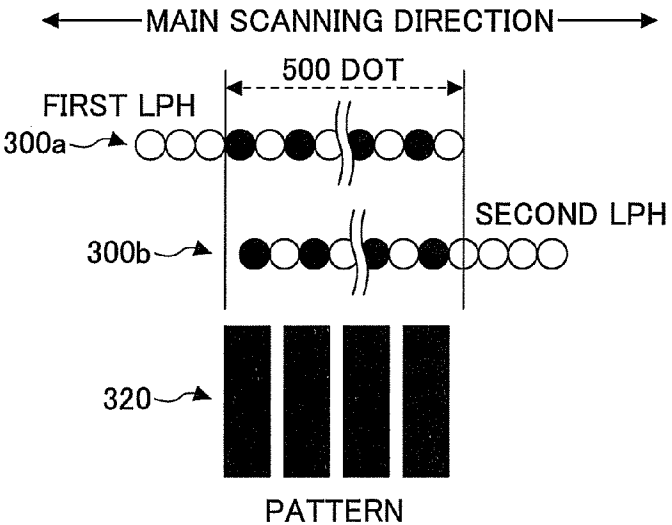
FIG. 3B shows a test pattern illustrated in correspondence with dots of first and second patterns in a case where the amount of deviation is substantially equal to the size of half a dot according to an embodiment of the present invention.

FIGS. 3A-3C are schematic diagrams for describing the principle for detecting the amount of deviation of the first and second printer heads 2, 3 at the boundary area. In this embodiment, the amount of deviation of the first and second printer heads 2, 3 at the boundary area between the first and second printer heads 2, 3 is substantially equal to or less than the size of a single dot. FIG. 3A shows a pattern (test pattern) 310 illustrated in correspondence with dots of the first and second patterns 300*a*, 300*b* (LEDs of the first and second printer heads 2, 3) in a case where there is no deviation of the first and second printer heads 2, 3 at the boundary area. FIG. 33 shows a test pattern 320 illustrated in correspondence with dots of the first and second patterns 300*a*, 300*b* (LEDs of the first and second printer heads 2, 3) in a case where the amount of deviation is substantially equal to the size of half a dot. FIG. 3C is a chart indicating the output of the density detection sensor 10 according to an embodiment of the present invention.

The image forming apparatus 1000 forms a test pattern including plural images on the photoconductor drum 9 at an overlapping region of the boundary area between the first and second printer heads 2, 3 and measures the density of the images of the test patterns formed on the photoconductor drum 9 with the density detection sensor 10. The test pattern is stored in the ROM 302 of the control device 300.

In a case of forming the test patterns 310, 320 (see, for example, FIG. 3A, 3B), images (printing marks) are formed on the photoconductor drum 9 without using transfer paper. Further, the test patterns 310, 320 are formed on the photoconductor drum 9 by alternately turning on and off a predetermined number of light emitting devices (e.g., LEDs) of the first and second printer heads 2, 3 provided at the overlap region. In FIGS. 3A, 3B, the black dots correspond to the light emitting devices (in this embodiment, LEDs) that are illuminated, and the white dots correspond to the light emitting devices (in this embodiment, LEDs) that are not illuminated. In the first and second printer heads 2, 3 according to an embodiment of the present invention, the light emitting devices of the first and second printer heads 2, 3 are alternately illuminated and not illuminated along a direction in which the dots are arranged at the overlap region. In FIGS. 3A and 3B, a black dot corresponds to a printing mark equivalent to a single dot, and a white dot corresponds to a non-printed area equivalent to a single dot. Thereby, by performing irradiation one dot each with the first and second printer heads 2, 3, the test pattern can be formed on the photoconductor drum 9. After forming the test patterns 310, 320, the image forming apparatus 1000 measures the density of the images of the test patterns 310, 320 by using the density detection sensor 10.

In a case of detecting the amount of deviation equivalent to substantially the size of one dot or less, the density of the images of the test pattern is thinnest (lightest) when there is no deviation of dots. On the other hand, output of the density detection sensor 10 becomes high when the detected image density is thin (light) and becomes low when the detected image density is low. Accordingly, the amount of deviation in the main direction of the first and second printer heads 2, 3 is detected based on the amount of change d between the output of the density detection sensor 10 at the overlap region of the boundary area when there is deviation and when there is no deviation (see FIG. 3C).

In other words, in a case where a line screen chart (chart having same black and white lines alternately arranged) of the first printer head 2 and a line screen chart of the second printer head 3 are formed and overlapped with each other, the density of images becomes thick/thin in accordance with interference of images. Thus, the density of images becomes thick when there is deviation of dots and becomes thin when there is no deviation of dots. Accordingly, the amount of position deviation can be detected by measuring the density of images with the density detection sensor 10 and calculating the amount of position deviation based on the amount of change of density.

Although the amount of position deviation can be detected with the above-described method, the direction of the position deviation (i.e. in this embodiment, the direction in which the second printer head 3 deviates in the main scanning direction with respect to the first printer head 2) cannot be detected.

As described in the following embodiment, by forming first and second patterns along with a third pattern in a case where the position deviation between the first and second printer heads 2, 3 is less than the size of a dot, either a first test pattern (combination of the first and second pattern) or a second test pattern (combination of the first and third pattern) is formed having a thickness greater than the first pattern (reference pattern). Therefore, either the first or second test pattern exhibits a greater density than the density of the first pattern. Accordingly, by comparing the density of the first and second test patterns (more specifically, comparing the voltage output from the density detection sensor 10 after measuring the densities of the first and second test patterns), it can be determined whether the position of the second printer head 3 is deviated to the right or left with respect to the position of the first printer head 2.

Figure 4A:
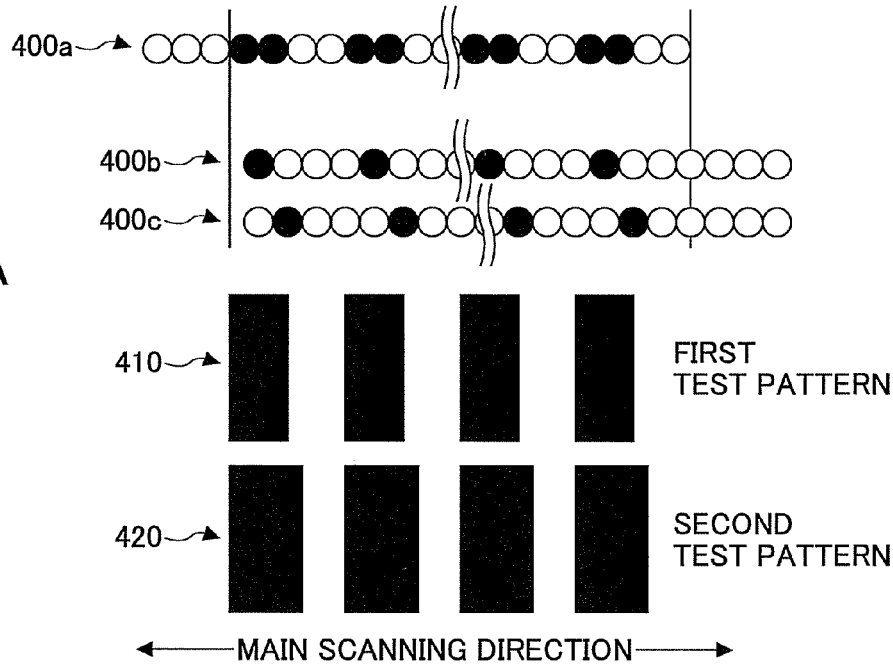
FIG. 4A illustrates a pattern of dots formed in a case where the position of a second printer head is deviated substantially half a dot to the right side according to an embodiment of the present invention.
Figure 4B:
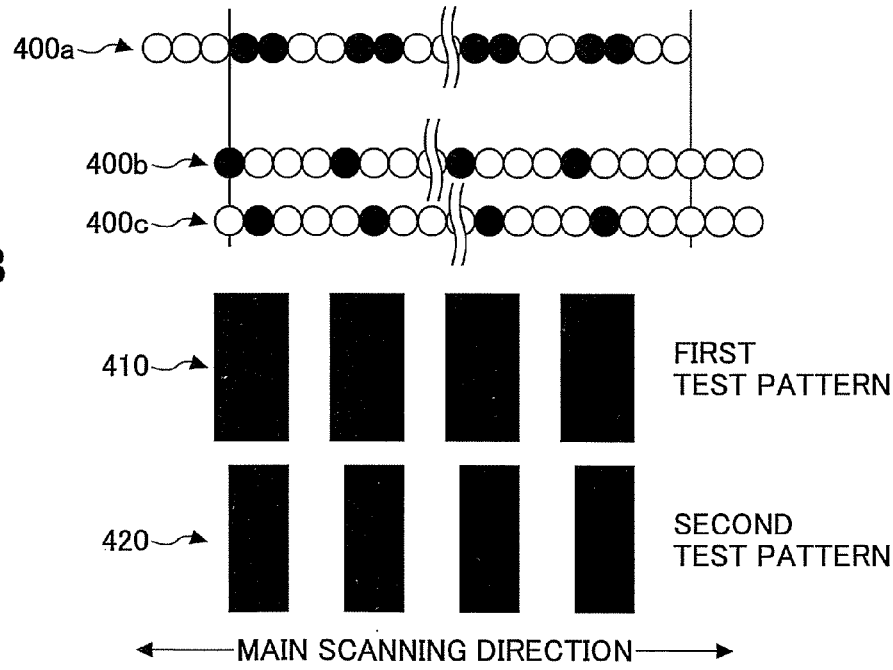
FIG. 4B illustrates a pattern of dots formed in a case where the position of a second printer head is deviated substantially half a dot to the left side according to an embodiment of the present invention.
Figure 4C:
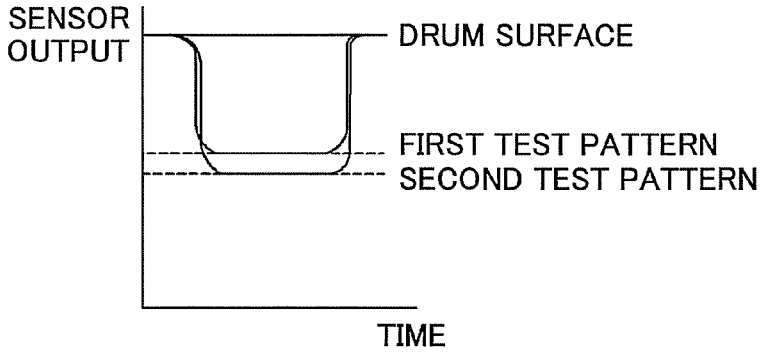
FIGS. 4C-4F are graphs illustrating the outputs of a density detection sensor according to an embodiment of the present invention.
Figure 4D:
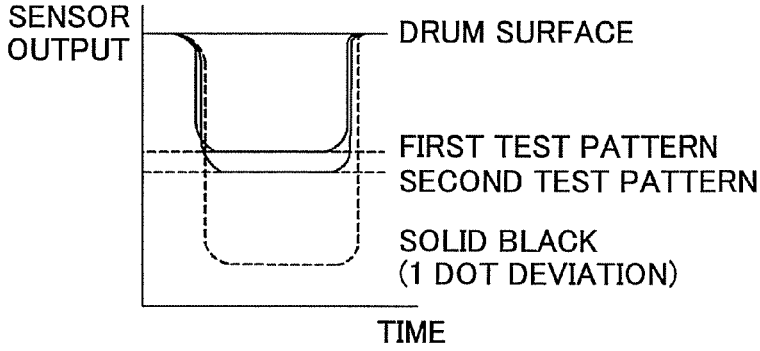
Figure 4E:
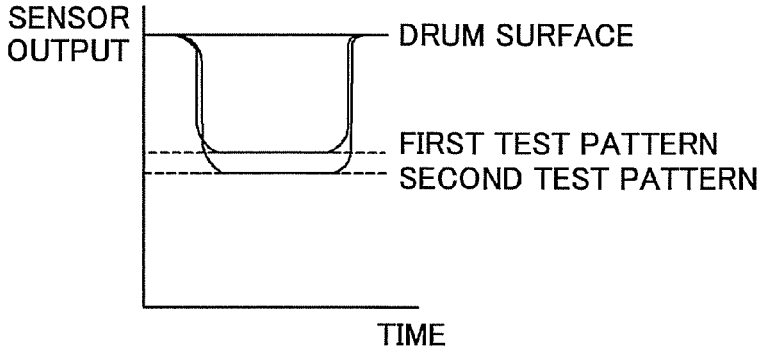
Figure 4F:
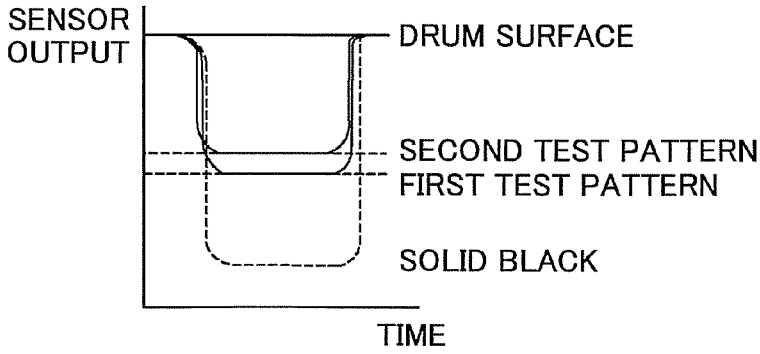

FIGS. 4A-4C are schematic diagrams for describing the principle for detecting the direction of deviation of the first and second printer heads 2, 3. In this embodiment, the direction of deviation of the first and second printer heads 2, 3 is substantially less than the size of a single dot. FIG. 4A illustrates a pattern of dots formed in a case where the position of the second printer head 3 is deviated substantially half a dot to the right side. FIG. 4B illustrates a pattern of dots formed in a case where the position of the second printer head 3 is deviated substantially half a dot to the left side.

In this embodiment, the position of the first printer head 2 serves as a reference position. The first printer head 2 irradiates light to the photoconductor drum 9 to form two dots at the left end of the overlap region and continues to form two dots every interval of two dots. Accordingly, a first pattern 400*a*, which includes a printing mark(s) equivalent to two dots (black dots) corresponding to illuminated LEDs and a non-printed area(s) equivalent to two dots (white dots) corresponding to non-illuminated LEDs alternately arranged on the photoconductor drum 9, is formed. Then, the second printer head 3 irradiates light to the photoconductor drum 9 to form a single dot at the left end of the overlap region and continues to form one dot every interval of three dots. The single dot formed at the left end of the overlap region corresponds to a dot which is to overlap with the printing mark formed at the left end of the first pattern 400*a*. Accordingly, a second pattern 400*b*, which includes printing marks (each printing mark equivalent to a dot (black dot)) and three consecutive non-printed areas (equivalent to three dots (white dots)) alternately arranged on the photoconductor drum 9, is formed. Then, as described in detail below, a third pattern 400*c* is formed in a similar manner as the second pattern 400*b* in which the second printer head 3 irradiates light to the photoconductor drum 9 to form a single dot at the right end of the overlap region and continues to form one dot every interval of three dots. The single dot formed at the right end of the overlap region corresponds to a dot which is to overlap with the printing mark formed at the right end of the first pattern 400*a*. Accordingly, the third pattern 400*c*, which includes printing marks (each printing mark equivalent to a dot (black dot)) and three consecutive non-printed areas (equivalent to three dots (white dots)) alternately arranged on the photoconductor drum 9, is formed. More specifically, in a case of forming the second pattern 400*b*, an LED of the second printer head 3, which matches the position of an LED of the first printer head 2 in the main scanning direction when the first and second printer heads 2, 3 are positioned a predetermined distance apart from each other, forms a predetermined printing mark (first printing mark) that overlaps a first end printing mark of the first pattern 400*a* (i.e. printing mark formed on one end of the first pattern 400*a*) in the main scanning direction. Likewise, in a case of forming the third pattern 400*c*, another LED of the second printer head 3, which matches the position of another LED of the first printer head 2 in the main scanning direction when the first and second printer heads 2, 3 are positioned a predetermined distance apart from each other, forms another predetermined printing mark (second printing mark) that overlaps a second end printing mark of the first pattern 400*a* (i.e. printing mark formed on one end of the first pattern 400*a*) in the main scanning direction.

In FIG. 4A, reference numeral 410 illustrates a first test pattern formed on the photoconductor drum 9 by combining the first and second patterns 400*a*, 400*b*. The width in which the first test pattern 410 is printed is substantially the same as the width in which the first pattern 400*a* is formed because the dot of the printing mark of the second pattern 400*b* overlaps the area where two dots of printing marks of the first pattern 400*a* are formed.

Then, in the same manner described above, the first pattern 400*a* is formed by irradiating light to the photoconductor drum 9 to form two dots at the left end of the overlap region and continues to form two dots every interval of two dots.

Then, the third pattern 400*c* is formed by shifting the second printer head 3 one dot rightward from the position of the second pattern 400*b* and illuminating an LED of a single dot at predetermined intervals. More specifically, the second printer head 3 irradiates light to the photoconductor drum 9 to form a single dot at a position corresponding to a second dot from the left end of the overlap region and continues to form one dot every interval of three dots. Accordingly, the third pattern 400*c*, which includes a dot (black dot) of a printing mark and three dots (white dots) of non-printed areas alternately arranged on the photoconductor drum 9, is formed.

In FIG. 4A, reference numeral 420 illustrates a second test pattern formed on the photoconductor drum 9 by combining the first and third patterns 400*a*, 400*c*. Because the second printer head 3 is deviated to the right with respect to the position of the first printer head 2 (in this embodiment, deviated half a dot to the right), the printing mark (black dot) positioned second from the left end of the third pattern 400*c* is deviated half a dot towards the right with respect to the right end of the printing mark of the consecutive two dots of the first pattern at the left end of the overlap region. Accordingly, the width in which the second test pattern 420 is printed is wider than the width of the first test pattern 410.

This shows that the width of the second test pattern 420 is wider than the first test pattern 410 in a case where the position of the second printer head 3 is deviated to the right with respect to the position of the first printer head 2. In other words, the density of the second test pattern 420 becomes higher than that of the first test pattern 410.

On the other hand, as illustrated in FIG. 4B, the width of the second test pattern 420 is narrower (in this embodiment, half a dot narrower) than the first test pattern 410 in a case where the second printer head 3 is deviated to the left with respect to the position of the first printer head 2 (in this embodiment, deviated half a dot to the left). That is, in this case, the first test pattern 410 has a higher density than that of the second test pattern 420.

Accordingly, by forming the first and second test patterns 410, 420, measuring the densities of the first and second test patterns 410, 420, and comparing the measured densities of the first and second test patterns 410, 420, it can be determined whether the position deviation between the first and second printer heads 2, 3 is deviated to the left or the right in the main scanning direction.

As illustrated in FIGS. 4C-4F, in comparing the outputs of the density detection sensor 10 corresponding to the first test pattern 410 and the second test pattern 420, it can be determined that the second printer head 3 is deviated to the right side with respect to the first printer head 2 in a case where the output of the density detection sensor 10 corresponding to the first test pattern 410 is greater than the output of the density detection sensor 10 corresponding to the second test pattern 420. Further, it can be determined that the second printer head 3 is deviated to the left side with respect to the first printer head 2 in a case where the output of the density detection sensor 10 corresponding to the first test pattern is less than the output of the density detection sensor 10 corresponding to the second test pattern 420.

Next, a method of calculating the amount of deviation between the first and second printer heads 2, 3 according to an embodiment of the present invention is described. The amount of deviation between the first and second printer heads 2, 3 can be calculated with the following Formula 1 by referring to the output of the density detection sensor 10 in a case where the second printer head 3 is deviated half a dot to the right with respect to the position of the first printer head 2 (black solid), the output of the density detection sensor 10 in a case where the second printer head 3 is deviated a single dot to the left or right with respect to the position of the first printer head 2, and the output of the density detection sensor 10 corresponding to the first pattern 400*a*.

Deviation amount (dot)=[first pattern−second test pattern/(first pattern−black solid)×*N* [Formula 1]

In Formula 1, the density of the first pattern 400*a* and the density of the black solid serve as reference density data (density data used for reference), and the density of the second test pattern (first pattern 400*a*+ third pattern 400*c*) 420 serve as deviation detection data (data used for detecting deviation). Alternatively, in a case where the second printer head 3 is deviated half a dot to the right with respect to the first printer head 2, the density of the first test pattern 410 may be used instead of the density of the first pattern 400*a* as the reference data because the first pattern 400*a* and the first test pattern (first pattern 400*a* second pattern 400*b*) 410 have substantially the same density (the second pattern 400*b* hides behind the first pattern 400*a*). In Formula 1, the letter "N" indicates the interval of dots (black dots, white dots) of the first pattern 400*a* formed by the first printer head 2. In a case where the amount of deviation is less than a single dot, N=1. In a case where the amount of deviation is less than four dots, N=4. In a case where the amount of deviation is less than eight dots, N=8. In this embodiment, N=2.

Likewise, the amount of deviation between the first and second printer heads 2, 3 can be calculated with the following Formula 2 by referring to the output of the density detection sensor 10 in a case where the second printer head 3 is deviated half a dot to the left with respect to the position of the first printer head 2, the output of the density detection sensor 10 in a case where the second printer head 3 is deviated a single dot to the left or right with respect to the position of the first printer head 2 (black solid), and the output of the density detection sensor 10 corresponding to the first pattern 400*a*.

Deviation amount (dot)=[first pattern−first test pattern/(first pattern−black solid)×*N* [Formula 2]

In Formula 2, the density of the first pattern 400*a* and the density of the black solid serve as density reference data (density data used for reference), and the density of the first test pattern (first pattern 400*a*+ second pattern 400*b*) 410 serve as deviation detection data (data used for detecting deviation). Alternatively, in a case where the second printer head 3 is deviated half a dot to the left with respect to the first printer head 2, the density of the first test pattern 410 may be used instead of the density of the first pattern 400*a* as the reference density data because the first pattern 400*a* and the second test pattern (first pattern 400*a*+ third pattern 400*c*) 410 have substantially the same density (the third pattern 400*c* hides behind the first pattern 400*a*). In Formula 2 of this embodiment, N=2.

FIGS. 4C-4F are graphs illustrating the output of the density detection sensor 10 corresponding to the density of the surface of the photoconductor drum 9 (to be used for calibration), the output of the density detection sensor 10 corresponding to the density of the first test pattern 410, and the output of the density detection sensor 10 corresponding to the density of the second test pattern 420. In the graphs of FIGS. 4C-4F, the vertical axis is for indicating the output of the density detection sensor 10 and the horizontal axis is for indicating time. Further, in the graphs of FIGS. 4D and 4F, the output of the density detection sensor 10 corresponding to the density of a solid black image (i.e. all LEDs being illuminated) is illustrated with dotted lines.

As described above, reference density data (density of first test pattern 410, density of black solid) are obtained in correspondence with the number of deviated dots (i.e., integers of 1, 2, 3, . . . ). Accordingly, by comparing the reference density data and the deviation detection data, the amount of deviation between the first and second printer heads 2, 3 can be accurately detected in units substantially equal to or less than a single dot (e.g., single dot deviation, half dot deviation).

Although the example illustrated with FIGS. 4A and 4B can detect the amount of deviation in units equal to or less than a single dot, the range of detecting the amount of deviation can be increased by changing the width of patterns. For example, in a case of detecting the amount of deviation equal to or less than two dots, the first pattern is formed by irradiating light from the first printer head 2 to the photoconductor drum 9 to form four dots every interval of four dots. Further, test patterns are formed with the second and third patterns 400*b*, 400*c* by irradiating light from the second printer head 3 to form two dots on both ends (i.e. left end, right end) of the first pattern 400*a*. In a case of detecting the amount of deviation in units equal to or less than four dots, the first pattern is formed by irradiating light from the first printer head 2 to the photoconductor drum 9 to form eight dots every interval of eight dots. Further, test patterns are formed with the second and third patterns 400*b*, 400*c* by irradiating light from the second printer head 3 to form four dots on both ends (i.e. left end, right end) of the first pattern 400*a*.

Further, in a case of measuring density with the density detection sensor 10, it is preferable to perform sampling plural times during a pattern reading period (i.e. period of rotating the photoconductor drum 9) and obtain an average value of density data excluding density data of the highest and lowest value.

Further, although toner images formed on the photoconductor drum 9 are transferred to transfer paper (not illustrated), transfer paper is not used when forming test patterns on the photoconductor drum 9.

Figure 5:
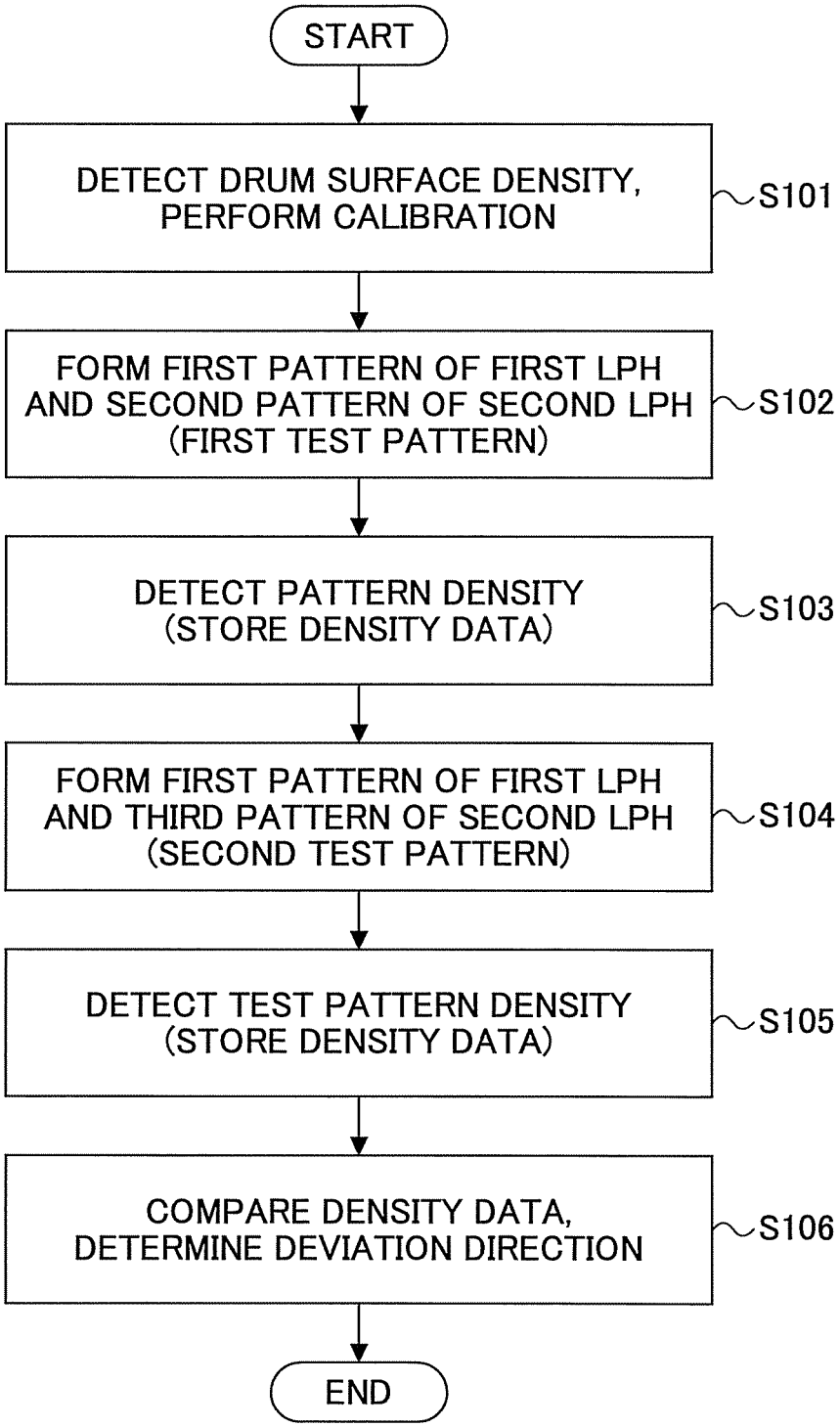
FIG. 5 is a flowchart illustrating an operation of detecting the direction of deviation at an overlap region (boundary area) between first and second printer heads according to an embodiment of the present invention.

FIG. 5 is a flowchart illustrating an operation of detecting the direction of deviation at the overlap region (boundary area) between the first and second printer heads 2, 3.

In the flowchart of FIG. 5, first, the photoconductor drum 9 is rotated, density data is read out from the surface of the rotated photoconductor drum 9, and calibration of the density detection sensor 10 is performed based on the read out density data (Step S101). In this embodiment, the calibration is performed by, for example, adjusting the amount of light of the density detection sensor 10, so that the density detection sensor 10 outputs a voltage of 4 V when reading out the density data from the photoconductor drum 9.

Then, in accordance with the instructions from the control unit 300, the control circuit 501 writes the first and second patterns 400*a*, 400*b* on the photoconductor drum 9 by using the first and second printer heads 2, 3 and forms the first test pattern 410 by combining the first and second patterns 400*a*, 400*b* (Step S102).

Then, the density detection sensor 10 measures the density of the first test pattern 410, and the control unit 300 stores the values of the measured density in the RAM 302 (Step S103).

Then, the control unit 501 writes the first and third patterns 400*a*, 400*c* on the photoconductor drum 9 by using the first and second printer heads 2, 3 and forms the second test pattern 420 by combining the first and third patterns 400*a*, 400*c* (Step S104).

Then, the position deviation direction determination part for executing the position deviation direction determining function of the control unit 300 measures (detects) the density of the second test pattern by using the density detection sensor 10 and stores the values of the measured density in the RAM 302 (Step S105).

The position deviation direction determination part of the control unit 300 reads out data of the measured densities of the first and second test patterns 410, 420 from the RAM 302 and detects the direction of position deviation by performing a relational operation (comparative operation) process on the measured densities of the first and second test patterns 410, 420 (Step S106).

As described above, it is determined that the second printer head 3 is deviated to the right side with respect to the first printer head 2 in a case where the output of the density detection sensor 10 corresponding to the first test pattern 410 is greater than the output of the density detection sensor 10 corresponding to the second test pattern 420 (i.e. a case where the value of the measured density of the first test pattern 410 is greater than the value of the measured density of the second test pattern 420). Further, it is determined that the second printer head 3 is deviated to the left side with respect to the first printer head 2 in a case where the output of the density detection sensor 10 corresponding to the first test pattern is less than the output of the density detection sensor 10 corresponding to the second test pattern 420 (i.e. a case where the value of the measured density of the first test pattern 410 is less than the value of the measured density of the second test pattern 420). Further, in a case where the measured density of the first test pattern 410 and the measured density of the second test pattern 420 are equal, it is determined that there is no position deviation between the first and second printer heads 2, 3 or determined that there is a match of dot images due to dots deviating in two dot intervals.

Hence, with the position deviation method according to the above-described embodiment of the present invention, first and second test patterns are formed by forming a first pattern including printing marks of a predetermined width, forming second and third patterns including printing marks narrower than the printing marks formed at the right and left ends of the first pattern, combining the first and second patterns, and combining the first and third patterns. Then, the direction of position deviation between the first and second printer heads by comparing the values obtained by measuring the densities of the first and second test patterns.

It is to be noted that, in a case where there is no change in the width of the printing marks it is determined that there is no position deviation between the first and second printer heads (no position deviation less than the size of a single dot. Because the position deviation detection can be achieved by simply adding the density detection sensor 10, the image forming apparatus 1000 requires no complex configuration and can be manufactured at a low cost.

In the above-described embodiment, the area in which the first pattern, the second pattern, the third pattern, the first test pattern, and the second test pattern are formed (i.e. boundary area between the first and second printer heads 2, 3 has a size equivalent to 50 dots (approximately 20 mm) in the main scanning direction and a size equivalent to approximately 500 consecutive lines in the sub-scanning direction as illustrated in FIG. 2C. Because the boundary area between the first and second printer heads is significantly larger than the area that can be measured by the density detection sensor 10, the output from the density detection sensor 10 can maintain a sufficient voltage even where the mounting position of the density detection sensor 10 is inconsistent or even where a density measurement point is deviated.

Although patterns are formed only in the overlap region between the first and second printer heads 2, 3 in the above-described embodiment of the present invention, patterns may be formed throughout the entire area in the sub-scanning direction of the first and second printer heads 2, 3.

Although two printer heads are used in the above-described embodiment of the present invention, the number of the printer heads is not limited to two. For example, the plural first printer heads 2 may be positioned at an upstream side in the sub-scanning direction and the plural second printer head 3 may be positioned at a downstream side in the sub-scanning direction. Further, although the amount of position deviation and the direction of the position deviation are determined by the control unit 300 which also controls the entire image forming apparatus 1000, the control unit for determining the amount of position deviation and the direction of the position deviation and the control unit for controlling the entire image forming apparatus 1000 may be separate control units. Although the first and second printer heads 2, 3 in the above-described embodiment of the present invention are LED printer heads, the first and second printer heads may be other types of printer heads. Further, although the photoconductor drum 9 has a drum-like shape, the photoconductor drum 9 may be formed in shapes other than the drum-like shape.

The present invention is not limited to the specifically disclosed embodiments, and variations and modifications may be made without departing from the scope of the present invention.

The present application is based on Japanese Priority Application No. 2010-063375 filed on Mar. 18, 2010, the entire contents of which are hereby incorporated herein by reference.

What is claimed is:

1. An image forming apparatus comprising:

a photoconductor drum;

a first printer head that forms a first pattern on the photoconductor drum and includes a first end part;

a second printer head that forms second and third patterns on the photoconductor drum and includes a second end part that overlaps the first end part in a main scanning direction;

a detection sensor that detects the densities of first and second test patterns formed at an area of the photoconductor drum at which the first and second end parts overlap, the first test pattern being formed by combining the first and second patterns, the second test pattern being formed by combining the first and third patterns; and a determination part that determines a deviation direction between the first and second printer heads by comparing the densities detected by the detection sensor.

2. The image forming apparatus as claimed in claim 1, wherein the first pattern includes a plurality of printing marks having a first end printing mark located at one end of the first pattern and a second end printing mark located at another end of the first pattern, wherein the second pattern includes a first printing mark that overlaps the first end printing mark, wherein the third pattern includes a second printing mark that overlaps the second end printing mark.

3. The image forming apparatus as claimed in claim 2, wherein the first printing mark is narrower than the first end printing mark, wherein the second printing mark is narrower than the second end printing mark.

4. The image forming apparatus as claimed in claim 2, wherein each of the first and second printer heads includes an array of a plurality of light emitting devices, wherein the plural printing marks including the first and second end printing marks, the first printing mark, and the second printing mark are images formed by irradiating light from at least one of the plural light emitting devices of the first and second printer heads.

5. The image forming apparatus as claimed in claim 1, wherein the detection sensor is configured to output voltages in correspondence with the measured densities, wherein the determination part is configured to compare the densities based on the voltages output from the detection sensor.

6. The image forming apparatus as claimed in claim 1, further comprising:

a storage part configured to store the densities detected by the detection sensor;

wherein the determination part is configured to obtain the densities stored in the storage part and determine the deviation direction between the first and second printer heads by comparing the densities obtained from the storage part.

7. The image forming apparatus as claimed in claim 1, further comprising a controller configured to transfer divided image data to the first and second printer heads, with the transferred divided image data to the second printer head being delayed in correspondence with a space between the first printer head and the second printer head.

8. A method for detecting deviation between first and second printer heads of an image forming apparatus, the method comprising the steps of:

a) forming a first pattern on a photoconductor drum;

b) forming second and third patterns on the photoconductor drum;

c) detecting the densities of first and second test patterns formed at an area of the photoconductor drum at which a first end part of the first printer head and a second end part of the second printer head overlap, the first test pattern being formed by combining the first and second patterns, the second test pattern being formed by combining the first and third patterns; and d) determining a deviation direction between the first and second printer heads by comparing the densities detected in step c).

9. The method as claimed in claim 8, wherein the first pattern includes a plurality of printing marks having a first end printing mark located at one end of the first pattern and a second end printing mark located at another end of the first pattern, wherein the second pattern includes a first printing mark that overlaps the first end printing mark, wherein the third pattern includes a second printing mark that overlaps the second end printing mark.

10. The method as claimed in claim 9, wherein the first printing mark is narrower than the first end printing mark, wherein the second printing mark is narrower than the second end printing mark.

11. The method as claimed in claim 9, wherein each of the first and second printer heads includes an array of a plurality of light emitting devices, wherein the plural printing marks including the first and second end printing marks, the first printing mark, and the second printing mark are images formed by irradiating light from at least one of the plural light emitting devices of the first and second printer heads.

12. The method as claimed in claim 8, wherein the step c) includes outputting voltages in correspondence with the measured densities, wherein the step d) includes comparing the densities based on the voltages output from the detection sensor.

13. The method as claimed in claim 8, further comprising a step of:

storing the densities detected in the step c);

wherein the step d) includes obtaining the densities stored in the storing step and determining the deviation direction between the first and second printer heads by comparing the densities stored in the storing step.

14. The method as claimed in claim 8, wherein the image forming apparatus further includes a detection sensor, wherein the method further includes a step of calibrating the detection sensor by detecting a density of a surface of the photoconductor drum.

15. The method as claimed in claim 8, further comprising transferring divided image data to the first and second printer heads, with the transferred divided image data to the second printer head being delayed in correspondence with a space between the first printer head and the second printer head.

16. A non-transitory computer-readable recording medium containing a program for causing a computer to perform the steps of:

a) forming a first pattern on a photoconductor drum;

b) forming second and third patterns on the photoconductor drum;

c) detecting the densities of first and second test patterns formed at an area of the photoconductor drum at which a first end part of the first printer head and a second end part of the second printer head overlap, the first test pattern being formed by combining the first and second patterns, the second test pattern being formed by combining the first and third patterns; and d) determining a deviation direction between the first and second printer heads by comparing the densities detected in step c).

* * * * *